United States Patent [19]

Jones

[11] Patent Number: 4,683,598

[45] Date of Patent: Aug. 4, 1987

[54] URINAL FOR USE BY FEMALES

[76] Inventor: Kathleen K. Jones, 2938 Owen Bell La., Pensacola, Fla. 32507

[21] Appl. No.: 882,389

[22] Filed: Jul. 7, 1986

[51] Int. Cl.[4] ..... E03D 13/00

[52] U.S. Cl. ..... 4/301; 4/144.1; 4/144.3

[58] Field of Search ..... 4/301, 144.1, 144.2, 4/144.3, 144.4, 114.1, 302

[56] References Cited

U.S. PATENT DOCUMENTS

| | | | |
|---|---|---|---|
| 2,968,046 | 1/1961 | Duke | 4/144.3 |
| 3,412,408 | 11/1968 | Michal, Jr. | 4/301 |
| 3,500,480 | 3/1970 | Michal, Jr. | 4/301 |
| 3,822,419 | 7/1974 | Wilson, Sr. | 4/301 X |
| 3,921,234 | 11/1975 | Mracek et al. | 4/144.1 X |
| 4,137,579 | 2/1979 | Solen | 4/144.3 |
| 4,145,768 | 3/1979 | Chevrette | 4/144.1 |
| 4,202,058 | 5/1980 | Anderson | 4/144.3 |
| 4,282,611 | 8/1981 | O'Day | 4/144.1 |
| 4,360,933 | 11/1982 | Kimura et al. | 4/301 |
| 4,549,321 | 10/1985 | Douillard | 4/301 |

*Primary Examiner*—Henry K. Artis

*Attorney, Agent, or Firm*—Needle & Rosenberg

[57] ABSTRACT

The present invention is a urinal for use by females which allows urination in a generally upright position and in a sanitary manner. The invention comprises a flexible tube with a flared upper end shaped to conveniently fit around the vaginal area and collect urine which drains down the inside of the flexible tube to a collected bowl. The collecting bowl may be located on the floor or against the wall.

6 Claims, 3 Drawing Figures

URINAL FOR USE BY FEMALES

BACKGROUND OF THE INVENTION

The present invention is in the field of toilet equipment, particularly urinals for use by females. Specifically, this invention discloses a urinal which can be utilized by females while in a generally upright position, and may be advantageously used in public restrooms and the like.

Many forms of toilets and urinals have been developed and disclosed in the prior art since indoor plumbing became common. However, despite the proliferation of toilet designs, no practical and commercially accepted form of urinal for female use has been designed.

A form of a prior art urinal is shown in U. S. Pat. No. 2,968,046 to W. A. Duke. This patent discloses an oblong shaped cup for receiving urine which is attached to a hose, which is drained to the plumbing by means of suction created by a jet effect by running water. This design does not provide for disposal of paper waste, such as toilet tissue. Furthermore, the use of a permanent cup could lead to unsanitary conditions, and the cup would have to either be cleaned in place or removed for cleaning. Neither situation is commercially practical.

U.S. Pat. No. 4,145,768 to Chevrette discloses another form of cup and hose urinal intended to be connected to a sink drain. This design is not specifically adapted for female use and requires the user to manually rinse the cup with water from the sink. Furthermore, it provides no means for disposing of waste.

U.S. Pat. No. 4,282,611 to O'Day discloses a urinal attachment for a standard toilet. As discussed and shown, this device does not appear suitable for use by females, and it does not utilize a hose or other complete connection to the plumbing; rather it is a funnel device to be utilized over the toilet. This patent does disclose a type of rinsing of the funnel, but this rinsing means does not work in association with the flushing of the toilet and requires manual control to turn the rinsing on and off. This rinsing would not be acceptable in the environment of a public bathroom.

U.S. Pat. No. 4,490,863 to Pate is a recent patent of the cup and hose design more particularly adapted for female use. However, this patent is specifically designed to save water and, therefore, has no waste flushing ability. This device utilizes a special vaginal insert for female use, but the disclosed insert is for purposes of adaptation of the device from male use to female use and is not intended to be disposable.

SUMMARY OF THE INVENTION

The present invention is a urinal for use by females which allows urination in a generally upright position and in a sanitary manner. The invention comprises a flexible tube with a flared upper end shaped to conveniently fit around the vaginal area and collect urine which drains down the inside of the flexible tube to a collecting bowl. The collecting bowl may be located on the floor or against the wall.

The flexible tube preferably has a rotating handle near the top so that the tube may be conveniently positioned with either hand. Also, disposable inserts may fit within the upper flared end of the flexible tube to cover the upper exposed edges of the flared end along with some of the inner and outer surface area, thereby providing a clean and sanitary surface on the area which may come into contact with the body. The disposable inserts may be conveniently dispensed by a dispenser located on or near the urinal.

The collecting bowl is connected at the upper portion to the bottom of the flexible tube, which opens into the bowl. Also provided in the bowl are one or more openings above the high water line for disposal of toilet tissue or the disposable inserts into the collecting bowl. The collecting bowl is connected at its bottom to standard plumbing for flushing and carrying water within the collecting bowl into the sewer system (for the purposes of this application, sewer system is intended to include septic or other systems for ultimate deposit of said waste). A water supply is provided directly to the collecting bowl under control of a standard flush control mechanism, for utilizing and carrying out the flushing operation.

Additionally, the flexible tube is provided with a hanging bracket or other means for supporting the upper end of the flexible tube in the rest position when not in use. A second water supply is located above the opening at the top of the tube when in the rest position and is also controlled by the flush control mechanism. This second water supply may provide a spray for the flared end of the tube which proceeds to rinse down the inside of the tube and is ultimately received in the collecting bowl. The upper spray from the second water supply should be operable only when the flexible tube is in the rest position.

Therefore, it is an object of the present invention to provide a practical and acceptable urinal for use by females.

It is a further object of the present invention to provide a female urinal for connection with standard plumbing systems which will accept and dispose of paper waste.

It is another object of this invention to provide disposable inserts in combination with a urinal intended for female use to provide a device suitable for use in public restrooms.

These and other objects and advantages will appear from the following description with reference to the drawings.

DESCRIPTION OF THE PREFERRED EMBODIMENT

The preferred embodiment is now described with reference to the drawings, in which like numbers indicate like parts throughout the figures.

Figure 1:
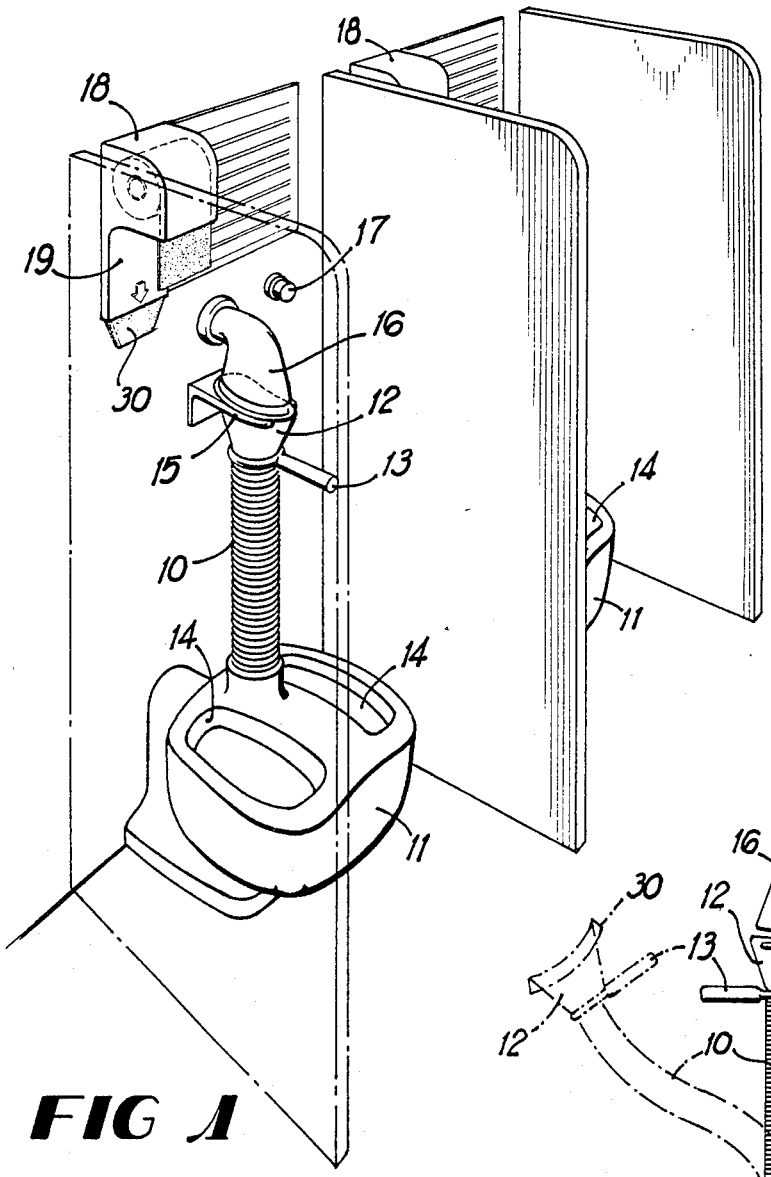
FIG. 1 is a front perspective view of the present invention.
Figure 3:
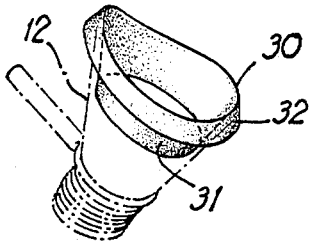
FIG. 3 is an enlarged view of a portion of the flared end of the flexible tube of the present invention showing a disposable insert placed therein.

FIG. 1 shows the female urinal as it would appear to a female entering a stall to use the invention. Flexible tube 10 is attached to collecting bowl 11 at its base and flared opening 12 is at the upper end of the flexible tube 10. The flared upper end 12 may either be of unitary construction with the flexible tube 10 or a separate piece attached to the tube 10. The flared upper end 12 opening is generally oblong so as to accommodate the female anatomy, as seen in FIG. 3. Preferably, the flexible tube 10 is of a kind which tends to support itself generally in its current position until intentionally moved, although the invention may be carried out with a totally flexible tube.

A handle 13 is attached to the tube 10 near the flared upper opening 12, and is rotatably attached such that handle 13 may swivel around the tube. However, the oblong opening maintains its orientation with its long dimension generally front to back for ease of use.

The collecting bowl 11 is shown mounted where the wall and floor meet, although it could be somewhat elevated from the floor. The bowl 11 has openings 14 at the top for disposing of refuse, such as toilet tissue. A rest hanger 15 is provided for holding the upper portion of the tube when not in use, and a rinsing and spraying nozzle 16 is located above the flared upper end 12 when it is in the rest position.

Conveniently located nearby the urinal are a flush button or lever 17, toilet tissue dispenser 18, and a dispenser 19 for disposable paper inserts as described below.

Figure 2:
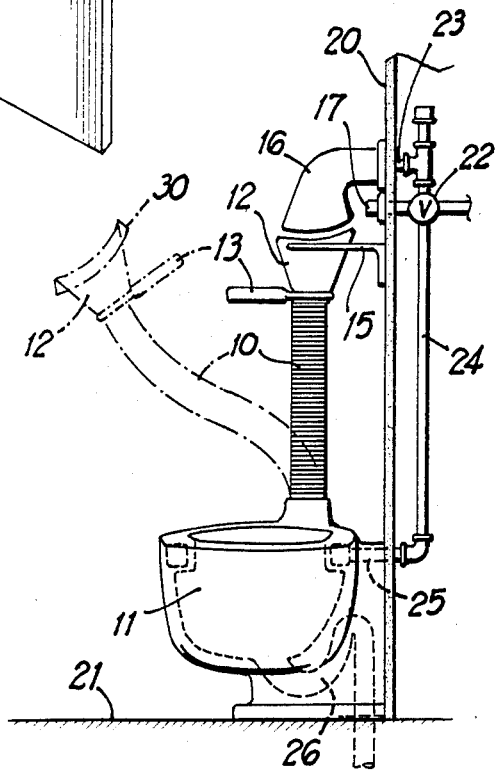
FIG. 2 is a side section view of the invention taken along line 2—2.

FIG. 2 is a side section view through the urinal and the wall 20 to which it is attached, showing the plumbing behind the wall, under the floor 21, and within the urinal. The flush button 17 activates a conventional valve 22 which provides a timed or measured flow of water to the upper pipe 23 and lower pipe 24. Upper pipe 23 directs a flow of water to sprayer 16. The operation of sprayer 16 should also require the flared end 12 to be in place in holder 15 so that the spray rinses the inside of the flared upper end 12 and the inside of tube 10 before draining into the bowl 11.

In addition, water enters the bowl 11 in a greater amount from outlet 25 from lower pipe 24. This water carries out a flushing cycle whereby the bowl 11 is rinsed and cleared of refuse which is disposed of through trap 26 into the sewer system.

FIG. 3 shows an enlarged perspective side view of the flared upper end 12 of the flexible tube 10. A disposable insert 30 is shown placed within and over the edges of the flared end. Such an insert is sized to fit around the inside surface of the flared end and to overlap at the edges. As shown, the insert is of a generally frustoconical shape 31 inside the flared end with flaps 32 bent over to overlap the edges and secure the insert in place. The inserts 30 are designed to be dispensed flat in a dispenser and to be opened for placement in the flared opening. When use of the urinal is completed, the insert may be disposed of through an opening 14 in the bowl 11, along with any toilet tissue used.

While this invention has been described in detail with particular reference to the preferred embodiment thereof, it will be understood that variations and modifications can be effected within the spirit and scope of the invention as previously described and as defined in the claims.

What is claimed is:

1. A urinal for use by females which comprises:

a flexible tube having an upper flared end for covering the vaginal area of a female to receive urine and rinsing means for rinsing said tube after use;

a collecting bowl, to which said flexible tube is unitarily and communicatively attached, for collecting the urine, and said bowl having at least one opening in its upper surface, which such openings are suitable only for disposal of refuse; and waste disposal means operable to rinse and flush said collecting bowl and to direct the urine and refuse into the sewer system.

2. The urinal of claim 1, which further comprises a means for rinsing the inside of said flexible tube concurrent with the operation of said waste disposal means.

3. The urinal of claim 2, which further comprises:

means for hanging the upper flared end of said flexible tube when not in use; and handle means rotatably connected near the upper flared end of said flexible tube for lifting said flexible tube away from said hanging means, maneuvering the flared end into position for use, and returning the flexible tube to said hanging means.

4. The urinal of claim 1, which further comprises a removable frustoconical liner insert which fits within, over, and around the upper flared end of said flexible tube.

5. The urinal of claim 4, wherein said removable insert is suitable to be disposable by said waste disposal means.

6. A urinal for use by females which comprises:

a flexible tube having an upper flared end for covering the vaginal area of a female to receive urine;

a collecting bowl, to which said flexible tube is communcatively attached, for collecting the urine, and said bowl further comprising at least one opening in its upper surface for receiving refuse for disposal;

waste disposal means operable to rinse and flush said collecting bowl and to direct the urine and refuse into the sewer system;

means for hanging the upper flared end of said flexible tube when not in use;

means for rinsing the inside of said flexible tube, said means comprising a rinse nozzle located adjacent said hanging means and independent of said flexible tube, such that said flexible tube may be rinsed when hanging on said hanging means; and sensing means for preventing the operation of said rinsing means when said flexible tube is not hanging on said hanging means.

* * * * *